US005655513A

United States Patent [19]

Whitfield

[11] Patent Number: 5,655,513

[45] Date of Patent: Aug. 12, 1997

[54] ARTIFICIAL LOG BURNER

[75] Inventor: Oliver J. Whitfield, Bow, Wash.

[73] Assignee: Pyro Industries, Inc., Burlington, Wash.

[21] Appl. No.: 613,408

[22] Filed: Mar. 11, 1996

[51] Int. Cl.[6] ..... F24C 3/00

[52] U.S. Cl. ..... 126/512; 126/92 AC; 431/125

[58] Field of Search ..... 126/512, 92 R, 126/92 AC, 92 A, 92 B, 91 R; 431/125, 126

[56] References Cited

U.S. PATENT DOCUMENTS

| | | | |
|---|---|---|---|
| 464,457 | 12/1891 | Goetz et al. | 431/125 |
| 697,941 | 4/1902 | Hewitt | 431/125 |
| 1,216,848 | 2/1917 | Schmidt | 126/92 B |
| 1,286,108 | 11/1918 | Richards | 431/125 |
| 3,993,430 | 11/1976 | Forker . | |
| 4,061,133 | 12/1977 | Swain | 431/125 |
| 4,194,489 | 3/1980 | Swain | 126/512 |
| 4,597,734 | 7/1986 | McCausland | 126/92 AC |
| 4,875,464 | 10/1989 | Shimek et al. . | |
| 5,026,579 | 6/1991 | Thow . | |
| 5,284,686 | 2/1994 | Thow . | |

FOREIGN PATENT DOCUMENTS

| | | | |
|---|---|---|---|
| 1128667 | 1/1957 | France | 126/92 R |

*Primary Examiner*—James C. Yeung
*Attorney, Agent, or Firm*—Christensen O'Connor Johnson & Kindness PLLC

[57] ABSTRACT

A gas burning imitation log assembly (18) including an imitation log (20) carried by a supply conduit (24) is disclosed. Supply conduit (24) receives gas from a gas source (26). The gas contained in supply conduit (24) escapes through aligned slots (34) passing through supply conduit (24) and log (20). In one embodiment of the invention, supply conduit (24) includes an outer sleeve (48) and an inner sleeve (46) which define a gas region (32). In an alternative embodiment of the invention, supply conduit (24) is not used. Gas is conveyed into log (20) which contains a diffusing layer (52) that overlays slots (34) to uniformly diffuse the gas through log (20).

9 Claims, 4 Drawing Sheets

ARTIFICIAL LOG BURNER

FIELD OF THE INVENTION

This invention relates to methods and apparatus for burning natural gas and, more particularly, to gas burning log assemblies which realistically imitate burning of actual wood logs.

BACKGROUND OF THE INVENTION

Combustible gas burning log assemblies have gained popularity over solid-fuel burning in recent years. As an alternative to solid-fuels, gas burning log assemblies have often been favored because they do not require laborious refueling and obviate the need for extensive clean-up efforts necessitated by, for example, the ashes formed by wood burning. Moreover, environmental concerns motivated both by private interest as well as governmental regulation have rendered the production of pollutants associated with wood burning particularly undesirable. These concerns are so great that in various parts of the country, during certain weather patterns, the burning of wood based products is generally prohibited.

To address these concerns, and provide an alternative to burning of wood logs, imitation ceramic logs have been developed. These logs have been used in, for example, fireplaces and stoves, to accompany flames generated by gas combustion. The ceramic logs are molded and decorated to resemble a natural wood log. The size, shape, and texture of natural wood logs are convincingly embodied in the ceramic logs. As accurate reproductions of wood logs, the use of ceramic logs in conjunction with gas flames has helped to provide a more realistic simulation of actual wood burning without some of its resulting drawbacks.

A variety of ceramic log assemblies have been designed. In one such design, ceramic logs are used in conjunction with an external gas burner that directs a time near the outer surface of a ceramic log without impinging on it. The combustion of gas normally results in a blue flame, readily identified as an artificial flame with little resemblance to the conventional yellow color of a natural wood burning time. In another design employing ceramic logs, a yellow flame can be achieved with suitable design of the burner taking care not to directly impinge the flame on the outer surface of the ceramic log. While certainly providing an alternative to wood fuel, such ceramic log assemblies have been only marginally effective at realistically imitating a wood burning fire. In addition, many prior designs of ceramic log assemblies suffer from the disadvantage of less than complete combustion which results in the production of undesirable soot which tends to blacken the logs and dangerous exhaust gases, such as carbon monoxide.

To address these disadvantages, other gas burning log assemblies have been produced. Such assemblies typically employed a tube for conveying gas from a source to the ceramic log assembly. As one example, attention is directed to U.S. Pat. No. 4,875,464 ('464 patent) by Ronald J. Shimek and Daniel C. Shimek, titled Clean Burning Gas Log Burner System. The '464 patent discloses decorative gas logs used in conjunction with a gas burner for producing times. The gas burner, mounted between or below decorative gas logs, is provided with a small, large, and auxiliary holes which must be precisely positioned in relation to one another. The decorative gas logs are supported independently from the gas burner. In one embodiment the large holes are positioned below corresponding apertures in a composite log set. An inverted U-shaped flame shield with a deflector portion prevents times from directly impinging on the decorative gas logs.

While the use of log assemblies as disclosed in the '464 patent overcome some disadvantages associated with earlier imitation log designs, they leave some disadvantages completely unaddressed and also pose new problems themselves. For example, the simulation of actual wood burning is not realistic. The position of the flame in relation to the decorative gas logs readily reveals the artificiality of the imitation assembly. Because the gas burner and the time shield, in one instance, are positioned substantially between decorative gas logs, the times produced do not appear to originate from the decorative gas logs. In addition, the position of the flames between the logs contrasts sharply with uniform flame distribution throughout the logs in the case of actual wood burning. In the one embodiment, as stated above, flames extend from the gas burner up through apertures on the composite log set, isolating the flames to discrete upper-most portions of the decorative gas logs. This flame emanation from discrete elevated portions of the decorative gas logs also fails to realistically portray actual weed burning where, in contrast, flames commonly envelop the entire surface of a log.

In addition to disadvantages involving its relatively artificial appearance, other disadvantages are also associated with the decorative gas log assembly of the '464 patent. For example, because the flames must not impinge on the decorative gas logs, the gas burner and flame shield with the decorative gas log must be cooperatively assembled and positioned in relation to one another for optimal performance. Such assembly necessitates substantial time and effort. Manufacturing costs are also unduly burdensome in providing, for example, precisely positioned holes of varying size on the gas burner and the protruding deflector of the flame shield.

The present invention is directed to overcoming the foregoing and other disadvantages. More specifically, the present invention is directed to providing a gas burning log assembly which safely and realistically simulates actual wood burning.

SUMMARY OF THE INVENTION

In accordance with this invention, a gas burning imitation log is provided. The apparatus includes an imitation log element and a supply conduit. Slots are strategically formed on and pass through the supply conduit and the imitation log element. The supply conduit carries the imitation log so that the slots on each component substantially coincide. When the ignition of the gas burning imitation log is desired, a combustible gas source delivers a gas/air mixture to an inlet of the supply conduit. Resulting pressure in the supply conduit caused by the entering gas drives the gas out of the supply conduit and through the slots. The emerging gas is then available for ignition at a location external to the supply conduit.

In accordance with a preferred embodiment of the present invention, the supply conduit includes an inner sleeve contained within an outer sleeve. The region between the inner sleeve and the outer sleeve defines a cavity for conveying gas along the length of the supply conduit.

In accordance with an alternative embodiment of the present invention, the imitation log element is sealed to allow the passage of gas only through the slots, and therefore eliminate the need for a separate supply conduit.

As will be readily appreciated from the foregoing summary, the invention provides a new and improved method and apparatus for gas burning log assemblies that safely and realistically imitate the burning of wood logs.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
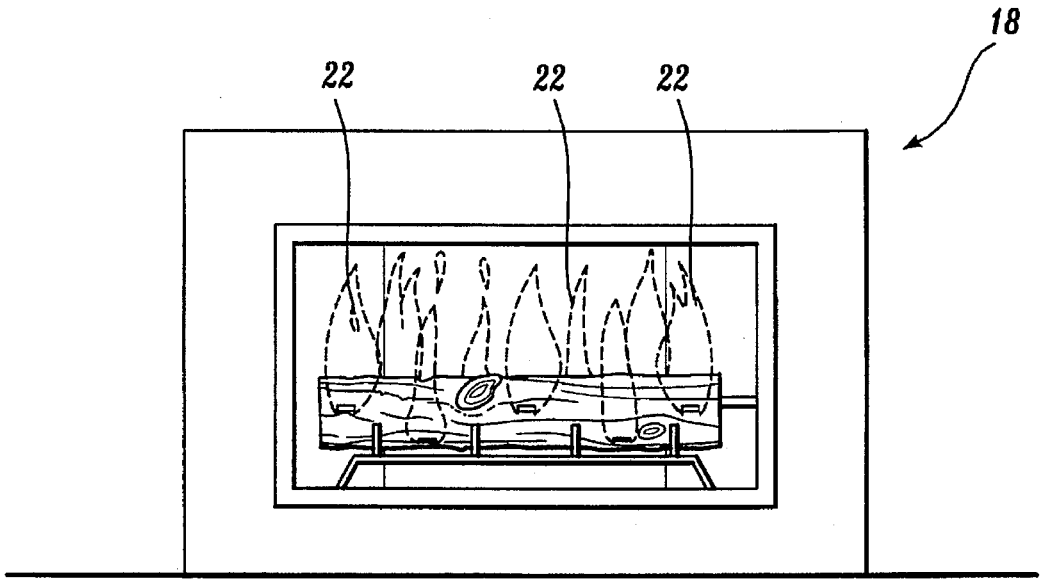
FIG. 1 is a pictorial diagram of a gas burning log assembly formed in accordance with this invention in use to simulate actual wood burning.
Figure 2:
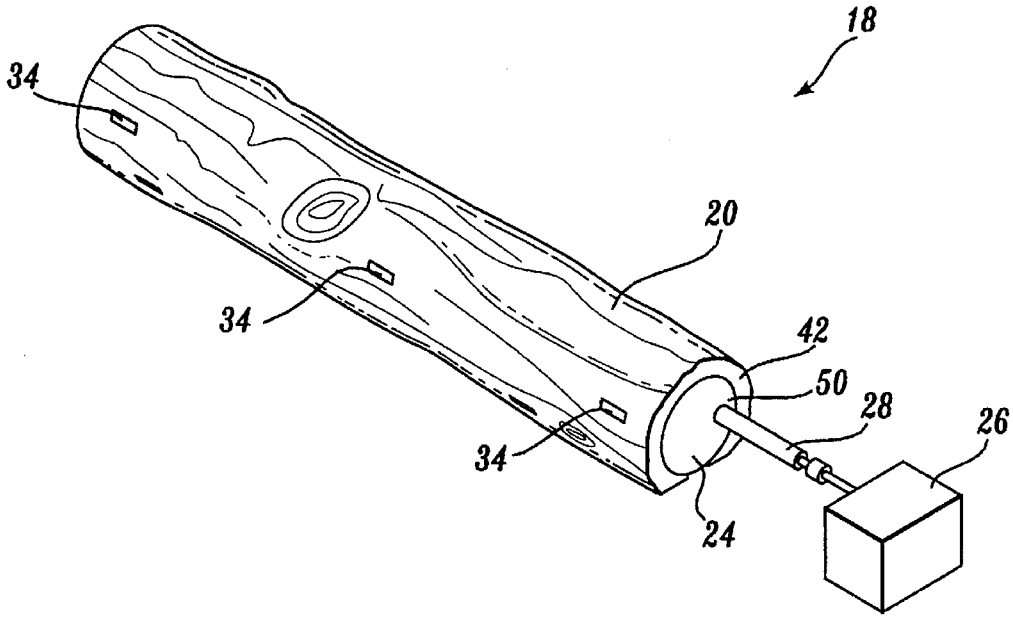
FIG. 2 is a perspective view of a gas burning log assembly formed in accordance with a preferred embodiment of the present invention suitable for imitating the appearance of actual wood burning.

FIG. 1 illustrates a realistic simulation of wood burning achieved by a gas burning imitation log assembly 18 formed in accordance with a preferred embodiment of the present invention. Referring to FIG. 2, when in use, gas is conveyed, using a venturi, for example, which can provide a regulated gas/air mixture, from a gas source 26 into a supply conduit 24 which carries an imitation log 20. The gas supply may enter the supply conduit 24 longitudinally from the end as shown in FIG. 2 or perpendicularly near the center of the supply conduit. Slots 34 are selectively positioned on both log 20 and supply conduit 24. Slots 34 on log 20 and on supply conduit 24 are aligned so that gas within supply conduit 24 diffuses through slots 34 to the exterior of tog 20 for combustion to create the realistic flames 22 (FIG. 1) emanating from log 20.

Figure 3:
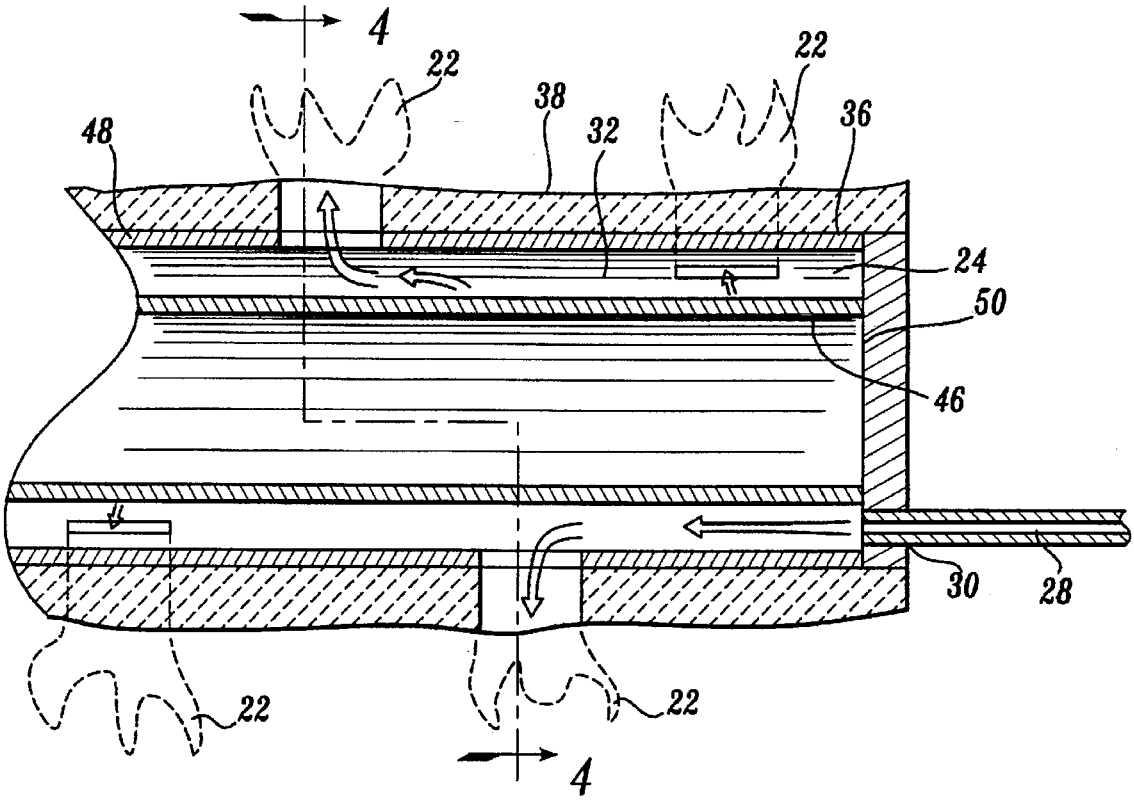
FIG. 3 is a longitudinal cross section of the embodiment of the invention shown in FIG. 2 and taken along line 3—3 of FIG. 4.
Figure 4:
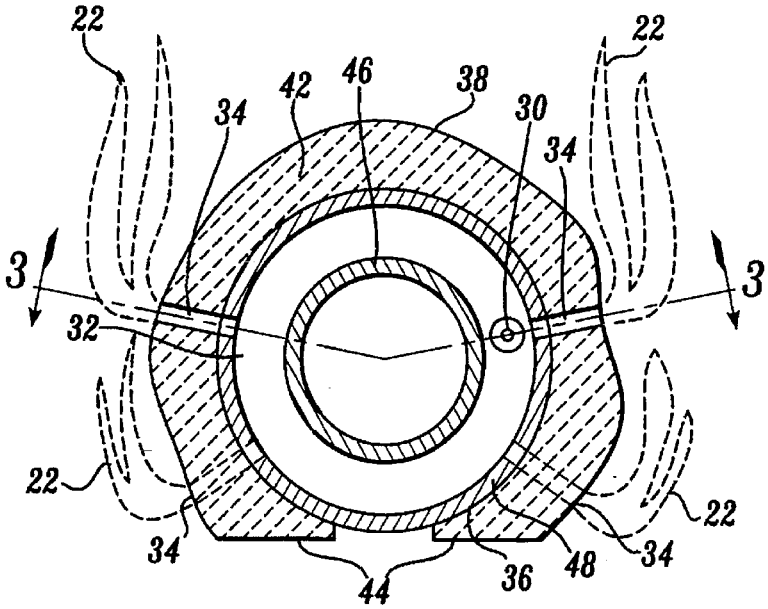
FIG. 4 is a cross-sectional view of the embodiment of the invention shown in FIG. 2 and taken along line 4—4 of FIG. 3.

Referring additionally to FIGS. 3 and 4, gas burning imitation log assembly 18 formed in accordance with a preferred embodiment of the present invention includes supply conduit 24 carrying log 20. Log 20 is imitation, resembling the appearance of a genuine wood log suitable, among other applications, for burning in a fireplace or stove. Although the following remarks describe the invention in relation to one log 20 formed in accordance with this invention, it is to be understood that a plurality of such logs can also be used in accordance with the method of the present invention. Log 20 can be made of ceramic or refractory materials or other non-combustible materials known in the art using conventional techniques such as molding or casting. Log 20 includes an inner surface 36 and an outer surface 38. Inner surface 36 is partially or wholly circular in cross section, incompletely or completely coveting supply conduit 24 as described in more detail below. The cross section of outer surface 38 is generally round, resembling a partial or full circle. Outer surface 38 is not smooth because it is textured and formed to resemble the appearance of an actual wood log. Slots 34 pass from outer surface 38 to inner surface 36 and are formed along log 20 at preselected vertical and horizontal locations thereon. Opposed end surfaces 42 located at longitudinal ends of log 20 are defined by the contour of inner surface 36 and outer surface 38 and bottom surfaces 44.

As described above, in the illustrated embodiment, log 20 does not completely surround supply conduit 24. Instead, log 20 leaves a lower longitudinal surface portion of supply conduit 24 exposed. Log 20 has spaced-apart longitudinal bottom surfaces 44 where log 20 opens to expose supply conduit 24. Bottom surfaces 44 are flat to generally provide more stable positioning of log 20.

The thickness of log 20 as measured from inner surface 36 to outer surface 38 can vary; however, the thickness should not be so great that the thermal mass of log 20 causes the combustion temperature to decrease to a point where the gas is not completely combusted. Partial combustion is undesirable because it results in the production of noxious carbon monoxide and the buildup of soot on log 20. To achieve complete combustion, the thickness of log 20 and the shape of the slots must be selectively chosen. Typically, log 20 is cooler than flame 22 generated by the combustion of the gas. Log 20 thereby acts to cool flame 22 and hinder complete combustion. As the thickness of log 20 adjacent the flame increases, flame 22 is increasingly cooled. In addition, the shape and position of the slots determine the degree of impingement of the flame on the ceramic surface as the flame issues from the log. Therefore, the thickness of log 20 and the shape of the slots should be chosen so that the impingement of the flame on the log and the resulting decrease in the temperature of the flame is minimized to avoid the production of carbon monoxide and soot associated with partial combustion. It has been observed that log thicknesses in the vicinity of the slots ranging from ⅛" to about ¼" are thin enough to minimize any adverse effect on the combustion temperature. The slots are preferably sized and shaped so that there is ample room for the flame to expand without impinging on the adjacent log structure. On the other hand, the size and shape of the slot should be small enough so that the slot is relatively hidden from view by the surrounding log. In addition, the velocity of the gas emanating from the slot will be a function of the size of the slot; accordingly, the slot should be sized so the flame wraps around the log and gives an appearance of licking the log's surface. While log 20 can take many other shapes, it is preferably formed to allow supply conduit 24 to carry log 20 over a substantial portion of outer surface 38 of supply conduit 24. In other words, the shape and size of log 20 is preferably chosen to cooperatively match the geometry of supply conduit 24 for a particular design of gas burning log assembly.

As described above in the illustrated embodiment, log 20 is carried and supported by supply conduit 24. Supply conduit 24 accepts gas from gas source 26. The gas diffuses through slots 34 formed thereon and is combusted outside supply conduit 24. During combustion, the velocity of the gas emerging from supply conduit 24 is great enough to substantially isolate flame 22 to a region outside supply conduit 24. If the supply of gas into supply conduit 24 is interrupted, however, the velocity of the gas emerging from supply conduit 24 through slots 34, in turn, decreases as a result of the reduced pressure within supply conduit 24. As the gas slows, flame 22 is able to extend into a region within supply conduit 24, a phenomenon known as "burn back". Burn back into supply conduit 24 makes the larger volume of gas within supply conduit 24 dangerously susceptible to combustion and, thus, creates a risk of an explosion of dangerous proportions. If the volume of supply conduit 24 containing gas is relatively large, the magnitude of the risk associated with burn back is attendantly increased.

To reduce such risk, supply conduit 24 preferably includes an inner sleeve 46 positioned inside an outer sleeve 48. This combination reduces the gas-containing volume of supply conduit 24 which reduces the risk of an explosive "burn back". Inner sleeve 46 and outer sleeve 48 are preferably made of steel. The longitudinal length of inner sleeve 46 and outer sleeve 48 are substantially equal, approximating the length of log 20. In the illustrated embodiment, inner sleeve 46 and outer sleeve 48 are circular in cross section, having respective diameters of about 2" and 3". The smaller diameter of inner sleeve 46 allows it to be concentrically positioned inside outer sleeve 48 as shown in FIG. 4. Inner sleeve 46 and outer sleeve 48 are rigidly connected together by their shared abutment, of their ends with two cap surfaces 50, only one of which is shown in FIG. 3. Cap surfaces 50 are preferably welded to or threaded with each sleeve. Cap surfaces 50 are located on each longitudinal end of the sleeves. Each cap surface 50 is circular with its radius substantially equal to the radius of outer sleeve 48.

The region defined between inner sleeve 46 and outer sleeve 48 is a gas region 32. As will be described in more detail below, gas region 32 accepts gas and conveys it outside supply conduit 24 for eventual combustion. Gas region 32 is preferably annular in cross section, being defined by the region between outer sleeve 48 and inner sleeve 46. In one embodiment, a gas region 32 having a volume of about 30%–50% of the volume of the supply conduit 24 was observed to perform satisfactorily from the standpoint of minimizing the explosiveness of any burn back. As will be discussed in more detail below, inner sleeve 46 does not have slots 34. Therefore, an inner cavity 40 defined by inner sleeve 46 is hermetically isolated from the gas in gas region 32.

As will be readily appreciated by those skilled in this art and others, supply conduit 24 could take other forms. Rather than steel, for example, supply conduit 24 could be made of other non-combustible materials. Similarly, while supply conduit 24 need not be as long as log 20, supply conduit 24 should be long enough to feed gas throughout a length of log 20 sufficient to provide a realistic burning appearance when using gas burning imitation log assembly 18. Although inner sleeve 46 and outer sleeve 48 are preferably cylindrical, inner sleeve 46 and outer sleeve 48 could be rectangular or triangular in cross section. Moreover, while the cross section of inner sleeve 46 and outer sleeve 48 are preferably similar in regard to shape, they may take different forms. For example, outer sleeve 48 could be circular in cross section while inner sleeve 46 was square in cross section. In any case, inner sleeve 46 must be rigidly attached to and preferably contained within outer sleeve 48. Although inner sleeve 46 and outer sleeve 48 are preferably attached at their longitudinal ends to cap surfaces 50, inner sleeve 46 and outer sleeve 48 could be securely attached together in various other ways. For example, struts extending from inner sleeve 46 to outer sleeve 48 could support inner sleeve 46 within outer sleeve 48. In any case, inner sleeve 46 should serve to reduce the volume of gas region 32 and thereby diminish the risk of an explosive burn back. It should be understood that a certain degree of bum back is inevitable as the gas pressure within supply conduit 24 drops. The present invention is not intended to eliminate burn back, but rather to limit the amount of gas combusted upon the occurrence of burn back.

A gas/air mixture is introduced into gas region 32 through an inlet 30. Inlet 30 is an opening on one end surface 42 of supply conduit 24 or perpendicularly through the supply conduit 24, preferably at the mid-section. Inlet 30 is positioned so that gas can be conveyed from tube 28 into gas region 32. Inlet 30 is preferably round to allow convenient mating with a pipe used to convey gas into gas region 32. The size of inlet 30 should match the dimension of the pipe so that a substantially airtight mating of tube 28 with supply conduit 24 can be achieved. Although inlet 30 is eccentrically positioned on one end surface 42 of supply conduit 24, it could also be located at other positions on supply conduit 24. For example, inlet 30 could be formed along the longitudinal surface of outer sleeve 48 rather than on end surface 42. A plurality of inlets could also be formed to allow the simultaneous introduction of gas into numerous locations in gas region 32. Of course, if more than one inlet 30 is to be used, a corresponding number of tubes 28 must also be employed to feed the gas through the various inlets 30 positioned on supply conduit 24. To accommodate a plurality of inlets 30 along outer surface 38 of supply conduit 24, openings on log 20 to allow access to such inlets must be provided if log 20 itself otherwise covers inlets 30.

As described above, slots 34 pass through both outer sleeve 48 and log 20 at preselected positions along and around their longitudinal surfaces. Slots 34 are preferably elongate openings strategically placed on outer sleeve 48 and log 20 to allow uniform and desirable gas diffusion from gas region 32. The direction of elongation of slots 34 is generally parallel to the length of outer sleeve 48 and log 20. Exemplary slots in the outer sleeve are about 1/16" inches wide and 2" inches long. The size of the slots in log 20 can vary and should be at least as large as the slots in outer sleeve 48. The size of the slots in the log near the top of the log can more closely match the size of the slots near the top of the outer sleeve. Preferably, the slots in the log below the top will begin to increase in size relative to the size of the corresponding slot in the outer sleeve in order to allow the flame to issue without impinging on the log. To imitate actual wood burning, slots 34 must be positioned selectively to evenly supply gas at various locations outside log 20 to realistically distribute flames 22. Even distribution of the gas along log 20 allows for a more realistic flame 22 appearance and thus a more faithful reproduction of actual wood burning.

Figure 5:
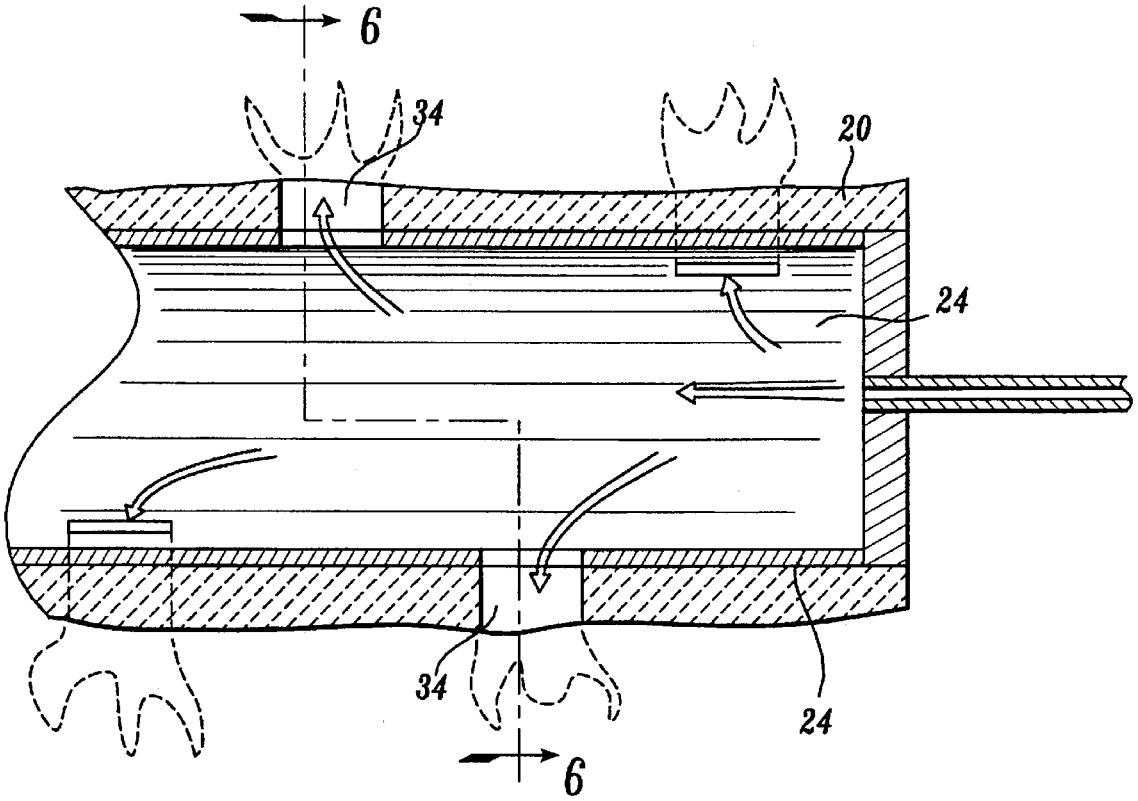
FIG. 5 is a longitudinal cross section of an alternative embodiment of the invention taken along line 5—5 of FIG. 6.
Figure 6:
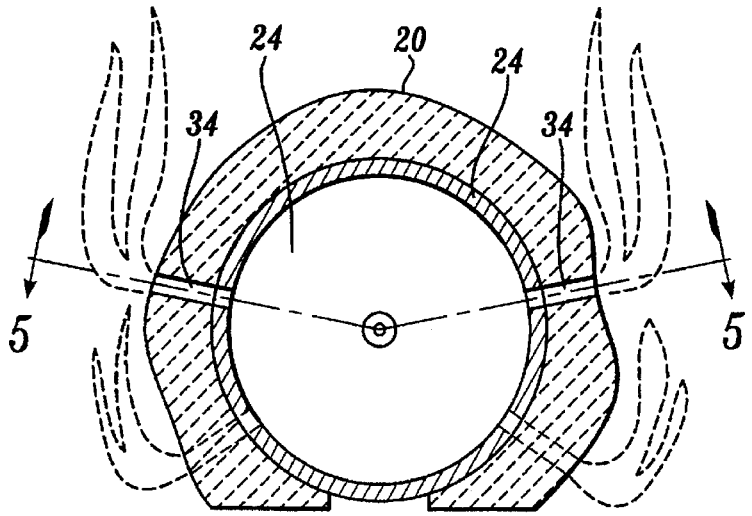
FIG. 6 is a cross-sectional view of the alternative embodiment of the invention shown in FIG. 5 taken along line 6—6 of FIG. 5.

FIGS. 5 and 6 illustrate gas burning imitation log assembly 18 formed in accordance with an alternative embodiment of the present invention wherein the inner sleeve is omitted. In the illustrated embodiment, supply conduit 24 is a cylindrical sleeve. As in the preferred embodiment illustrated in FIGS. 1–4, slots 34 are formed on supply conduit 24 to coincide with slots 34 on log 20. Gas region 32 is the region defined by supply conduit 24. Inlet 30 is preferably positioned near the center of an end surface. Because other details of this alternative embodiment would be redundant with the foregoing description of the corresponding features of the preferred embodiment, they will not be repeated.

Figure 7:
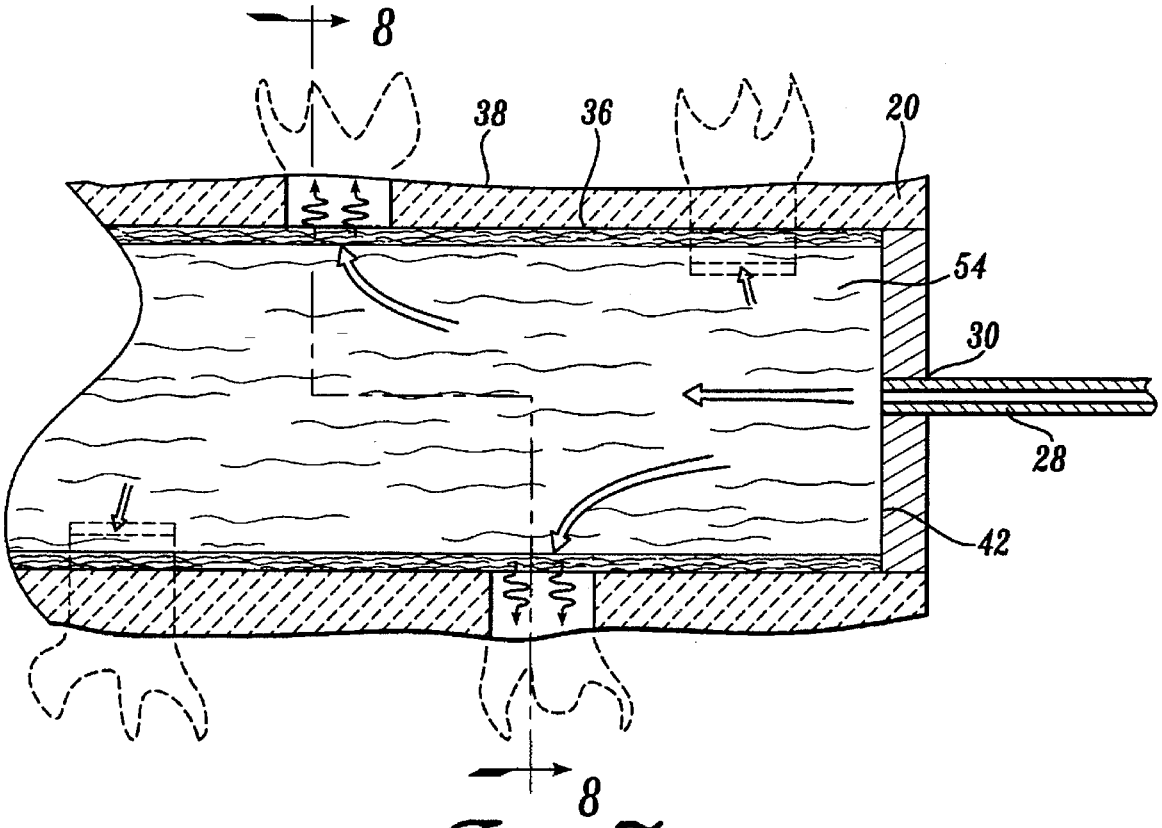
FIG. 7 is a longitudinal cross section of an alternative embodiment of the invention illustrating a diffusing layer taken along line 7—7 of FIG. 8.
Figure 8:
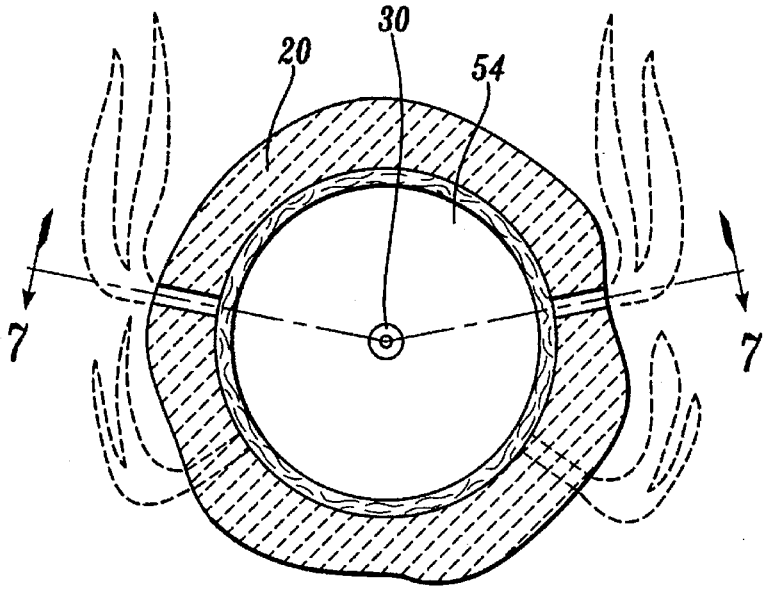
FIG. 8 is a cross-sectional view of the alternative embodiment of the invention shown in FIG. 7 taken along line 8—8 of FIG. 7.

FIGS. 7 and 8 illustrate gas burning imitation log assembly 18 formed in accordance with another alternative embodiment of the present invention. Gas burning log assembly 18 includes cylindrical log 20 having closed ends and inner surface 36 and outer surface 38. Log 20 defines a substantially enclosed log cavity 54. Inner surface 36 is circular in cross section. Outer surface 38 is substantially circular, but not smooth because of its artificial texture. In this embodiment, log 20 is either manufactured from a gas impermeable material or is sealed so that gas may only pass from inner cavity 40 to the outside of log 20 through slots 34. To create the burning effect of log 20, gas is delivered to log cavity 54 by tube 28 positioned at inlet 30. Preferably, inlet 30 is positioned to accept gas at end surface 42 of log 20. However, as stated above with respect to the preferred embodiment, inlet 30 may be positioned elsewhere. When the gas is conveyed to inner cavity 40, increasing pressure therein causes gas to diffuse through slots 34. Because log 20 is sealed, gas cannot escape except through slots 34. As the gas emerges from log 20, it can be ignited to create the appearance of burning wood.

Gas emerging from slots on ceramic logs is often not evenly distributed along the length of the logs. As a result, prominent flames are localized to discrete areas along the ceramic log where the gas is concentrated, preventing an accurate simulation of the uniform flame 22 patterns produced in actual wood burning. In addition, gas commonly leaves the openings on the ceramic log at undesireable speeds. When the velocity of emerging gas is too great, a flame tends to be directed away from the log in a substantially nonvertical direction. The orientation of such flames is inconsistent with flames produced in wood burning that lick the surface of the wood rather than dart away from it. To reduce such nonuniformity and increase licking, a diffusing layer 52 can be placed inside log 20 to overlay slots 34. Diffusing layer 52 achieves a more uniform diffusion of gas throughout the log which helps to create a consistent flame 22 pattern along log 20. Preferably, diffusing layer 52 is made of a steel wool material, or other flexible non-flammable gas permeable material. Diffusing layer 52 is placed against inner surface 36 of log 20. Accordingly, diffusing layer 52 is circular in cross section. Of course, other porous, non-combustible materials besides steel wool could be used. Because a discussion of the remaining aspects of this embodiment would be redundant with the foregoing discussion, the remaining aspects are not discussed below.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A gas burning imitation log comprising:

an imitation log element;

an elongate conduit carrying said imitation log element, said elongate conduit configured to receive combustible gas; and a plurality of openings passing through said elongate conduit and said imitation log element, each of said openings passing through said elongate conduit substantially coinciding with said openings passing through said imitation log element, said openings promoting combustion of said combustible gas substantially outside said imitation log element as said combustible gas emerges from said elongate conduit and said imitation log element through said openings.

2. The gas burning imitation log of claim 1, wherein said elongate conduit is completely surrounded by said imitation log element.

3. The gas burning imitation log of claim 1, wherein said elongate conduit is substantially circular in cross section.

4. The gas burning imitation log of claim 1, wherein said elongate conduit further comprises:

an outer sleeve having said openings;

an inner sleeve, said inner sleeve rigidly positioned within said outer sleeve to define a cavity between said outer sleeve and said inner sleeve for receiving said gas, said cavity having a constant cross-sectional area along its length; and a gas inlet for receiving combustible gas into said cavity.

5. The gas burning imitation log of claim 4, wherein the volume defined between by said inner sleeve and said outer sleeve is less than the volume defined by said outer sleeve in the absence of said inner sleeve, said volume defined by said inner sleeve hermetically isolated from said combustible gas.

6. The gas burning imitation log of claim 5, wherein said inner sleeve is hermetically isolated from said cavity.

7. The gas burning imitation log of claim 5, wherein said outer sleeve is substantially circular in cross section.

8. The gas burning imitation log of claim 1, wherein said elongate conduit includes a filler element for reducing the volume capable of being occupied by said gas within said elongate conduit.

9. A method of providing combustible gas to a gas burning imitation log, comprising the steps of:

conveying combustible gas to an elongate conduit;

providing a plurality of openings passing through said elongate conduit and an imitation log element;

aligning said openings of said elongate conduit with said openings of said imitation log element;

allowing said combustible gas to flow first into said elongate conduit and then through said openings; and combusting said combustible gas substantially outside said elongate conduit and said imitation log element.

* * * * *